US007214107B2

(12) United States Patent
Powell et al.

(10) Patent No.: US 7,214,107 B2
(45) Date of Patent: May 8, 2007

(54) ELECTRICAL CONNECTOR APPARATUS AND METHODS

(75) Inventors: Francis Powell, Cheshire, CT (US); John Janczek, Lino Lakes, MN (US); Dennis G. Hepp, Coon Rapids, MN (US)

(73) Assignee: Cardiodynamics International Corporation, San Diego, CA (US)

( * ) Notice: Subject to any disclaimer, the term of this patent is extended or adjusted under 35 U.S.C. 154(b) by 0 days.

(21) Appl. No.: 10/995,610

(22) Filed: Nov. 22, 2004

(65) Prior Publication Data

US 2006/0110962 A1 May 25, 2006

(51) Int. Cl.
*H01R 4/48* (2006.01)

(52) U.S. Cl. ..... 439/729

(58) Field of Classification Search ..... 439/268, 439/729, 819, 822, 859, 909, 910, 930
See application file for complete search history.

(56) References Cited

U.S. PATENT DOCUMENTS

| | | | |
|---|---|---|---|
| 1,212,821 | A | 1/1917 | Schade, Jr. |
| 2,082,279 | A | 6/1937 | Fore |
| 2,758,947 | A | 8/1956 | Feighner |
| 3,774,143 | A | 11/1973 | Lopin |
| 4,040,697 | A | 8/1977 | Ramsay et al. |
| 4,178,052 | A | 12/1979 | Ekbom et al. |
| 4,206,960 | A | 6/1980 | Tantillo et al. |
| 4,220,387 | A | 9/1980 | Biche et al. |
| 4,671,591 | A | 6/1987 | Archer |
| 5,277,613 | A | 1/1994 | Neward |
| 5,895,298 | A | 4/1999 | Faupel et al. |
| 6,142,949 | A | 11/2000 | Ubby |
| D468,433 | S | 1/2003 | Wagner et al. |
| D471,281 | S | 3/2003 | Baura et al. |
| D475,138 | S | 5/2003 | Baura et al. |
| 6,636,754 | B1 | 10/2003 | Baura et al. |
| 2003/0068914 | A1 | 4/2003 | Merry et al. |
| 2004/0039275 | A1 | 2/2004 | Sato et al. |
| 2004/0072475 | A1 | 4/2004 | Istvan |
| 2004/0106964 | A1 | 6/2004 | Fischer et al. |

FOREIGN PATENT DOCUMENTS

| | | |
|---|---|---|
| CH | 48890 | 7/1909 |
| DE | DD 257-145 | 8/1998 |
| FR | 964611 | 8/1950 |

*Primary Examiner*—Khiem Nguyen
(74) *Attorney, Agent, or Firm*—Gazdzinski & Associates

(57) ABSTRACT

Electrical connector apparatus optimized for biomedical applications. In one embodiment, the connector apparatus comprises a low-cost simplified device having a unitary conductor element adapted to interface with an electrode terminal such as used in impedance cardiography (ICG) or electrocardiography (ECG). The unitary conductor is shaped so as to provide a high degree of electrical performance and signal stability, and also be highly reliable. The simplified structure of the connector (including the use of the unitary conductor element) allows it to be manufactured for very low cost, so as to be disposable if desired. Methods of manufacturing and operating the connector are also disclosed.

19 Claims, 12 Drawing Sheets

(PART 1 OF 2)

(PART 2 OF 2)

ELECTRICAL CONNECTOR APPARATUS AND METHODS

BACKGROUND OF THE INVENTION

1. Field of the Invention

The present invention relates generally to the field of electrical connectors and connection apparatus, and particularly to an electrical connector apparatus useful in, inter alia, biomedical applications.

2. Description of Related Technology

In certain electrical connector applications, multiple (often competing) design and performance requirements exist, thereby significantly constraining the selection of connector technology for use in that application. This is especially true of certain clinical or biomedical applications such as impedance cardiography (ICG) and electrocardiography (ECG), wherein it is highly desirable to have a connector which is low cost, clinically rugged and robust, yet which provides both acceptable electrical performance (including low impedance) in a stable and repeatable manner. ICG and ECG connector assemblies have been historically characterized by high cost and substantial complexity of design. Unfortunately, such high cost tends to steer the clinician (or medical facility) using the connector away from disposing of these devices on a routine basis, as well as creating significant barriers to adoption of the technology in the first place.

Ideally, ICG/ECG connectors would be very simple in construction and low in cost, thereby allowing routine replacement and more ubiquitous use of these techniques in general.

Operational simplicity is another important consideration. Preferably, no complex or difficult operations would required in order to connect or disconnect the connector, yet the engagement (or disengagement) would be positive and rapid.

A great variety of different electrical connector designs (biomedical and otherwise) are known in the prior art, the following being generally representative.

Swiss Patent No. 48,890 to Cuendet issued July 1909 discloses a metallic loop element with aperture adapted for mating with a spark plug electrode. The loop is expanded by biasing two portions of the loop toward one another against a spring force.

U.S. Pat. No. 1,212,821 to Schade discloses a device for spring fastening a wire device to an electrical conductor.

U.S. Pat. No. 2,082,279 to Fore discloses a clip insulator adapted to be placed over the uninsulated portion of a conductor terminal.

U.S. Pat. No. 2,758,947 to Feighner discloses a method of clamping a spring loaded clip onto wires, terminals or other electrical conductors.

French Patent No. 964,611 to Ford issued August 1950 discloses a metallic loop element with aperture adapted for mating with a spark plug electrode. The loop is expanded by biasing two portions of the loop toward one another.

U.S. Pat. No. 3,774,143 to Lopin discloses an adapter for use in making an electrical connection between an electrode and a cable connected to a monitoring instrument.

U.S. Pat. No. 4,040,697 to Ramsay, et al. issued Aug. 9, 1977 entitled "Electrical connector" discloses an electrical connector that has a resilient, stamped, metallic leaf contact defining a narrow neck contact entrance area and having reversely bent ends on either side of said area. A plastic body section embeds the ends and spans the area to provide two side by side lever legs arranged to act so that pressure on the legs resiliently opens the narrow neck to allow entrance of a second body contact. Relaxation of pressure on the legs causes resilient action of the connector to provide gripping of the second contact with a positive three point grip.

U.S. Pat. No. 4,178,052 to Ekbom, et al. issued Dec. 11, 1979 entitled "Medical terminal clip member for attachment to patient electrodes" discloses a medical terminal clip that has a body member with a longitudinal axis and a pair of laterally spaced leg members extending in approximately the longitudinal direction and pivotally connected for relative movement. The respective spaced leg members form a variably spaced electrode receptacle on one side of the pivotal connection. A beryllium copper conductive member is embedded in the body member and is formed from a strip of metal bent into approximately an M-shape with side flanges on the leg members to ostensibly provide additional strength. A shield or barrier member extends at least between the approximate ends of the leg members on the other side of the pivotal connection while permitting relative movement of the leg members. The shield member is designed to close longitudinal access to the space between the leg members and thereby prevent any dislocation of the terminal clip member by catching onto exterior objects such as other terminal wires.

U.S. Pat. No. 4,206,960 to Tantillo, et al. issued Jun. 10, 1980 entitled "Electrical connector" discloses an electrical connector for engaging a terminal stud that has first and second insulating spring arms each carrying a conductive metal contact with the metal contacts defining through holes for electrically contacting a shank of a terminal stud. The metal contacts normally are in opposed spaced relationship to each other but are superimposed over each other and resiliently biased to their original position when the spring arms are squeezed toward each other by finger pressure. Release of the pressure causes the contacts to grasp the shank of a terminal stud over which the contacts are positioned. An electrical connector is formed by positioning a preformed end piece over an insulated wire and then molding a plastic connector end in abutting relationship with at least a portion of said preform whereby the molding and forming temperature used does not adversely affect the insulation of said wire.

U.S. Pat. No. 4,220,387 to Biche, et al. issued Sep. 2, 1980 entitled "Medical clip" discloses a medical terminal, particularly for use in connecting a lead wire or conductor to an electrode conventionally secured to the skin surface of a human or animal. The electrode comprises a male projection of the buttontype with an enlarged diameter head portion disposed within a recessed area of the electrode. The clip is generally V or wishbone shaped and includes a pair of support arms secured together at one end and normally spaced from each other at the other end. The arms carry resilient conductive loops normally biased out of overlapping condition but movable upon the application of external force into an overlapped condition wherein the clip may be applied over the head portion of the electrode. The support arms have offset depending shoulder portions from which the conductive loops extend and which are positionable within the recessed area of the electrode when the arms are moved toward each other. The support arms are integrally formed of resilient dielectric plastic material in an initial unstressed generally V-shape, with a female socket embedded in the plastic and electrically connected by conductor means to the conductive loops. Replaceable or interchangeable identification means is removably mounted on the clip in the area of the female socket, and a strain relief cover is removably positionable on the clip over said female socket and over said identification means to provide strain relief for the connection to a lead wire, and the cover is at least in part transparent to provide visual observation of the identification means.

German Patent No. DD 257 145 discloses a contact terminal clamp designed for use in medical applications, which provides a connection to dish-shaped electrodes on a patient. A double loop terminal element is coupled around a terminal stud, with the loop aperture being opened by grasping two opposing free ends of the terminal element and compressing them together.

U.S. Pat. No. 4,671,591 to Archer issued Jun. 9, 1987 entitled "Electrical connector" discloses a connector for establishing electrical connection between a conductor and a patient engaging electrode that includes a conductive post extending from the electrode. The post has a proximal portion, a distal portion, and an intermediate portion having a diameter smaller than the diameter of the distal portion. The connector comprises insulation means shaped to form a socket open at one end, a pair of first spring members, a pair of second spring members, and means for electrically connecting the conductor to the second spring members. The first spring members are laterally positioned with respect to one another in the socket, and the second spring members are laterally positioned with respect to one another in the socket closer to said one end than the first spring members. The first and second spring members are positioned and constructed such that when the post is inserted in the socket, the second spring members grip the proximal portion of the post, and the first spring members and the intermediate and distal portions of the post comprise a detent mechanism that resists removal of the post from the socket.

U.S. Pat. No. 5,277,613 to Neward issued Jan. 11, 1994 entitled "Electrode junction assembly" discloses an electrical junction block particularly for use with a fetal electrode and electronic monitor. The junction block comprises a housing having a cavity therein, and a substantially U-shaped spring disposed in the cavity. The spring has legs which are biased outwardly by a suitable coil spring. The housing contains electrical contacts and wires connected thereto, and the U-shaped spring can be depressed to provide openings for receiving electrode wires. A mounting pad can be disposed on the housing for facilitating mounting of the assembly on a person during use.

U.S. Pat. No. 5,895,298 to Faupel, et al. issued Apr. 20, 1999 entitled "DC biopotential electrode connector and connector condition sensor" discloses an electrode connector and connector condition sensor for a biopotential sensing apparatus. A plurality of electrodes are connected to individual output leads for individual electrode channels by a connector which does not abrade the surface of the electrode button contact and does not require that pressure be applied to the electrode during connection. Two spring biased conductive arms for the connector are spread apart by the cam surface of an actuator button to receive the button contact and are contoured to engage substantially the peripheral surface of the button contact when the actuator button is released. The biopotential sensing apparatus includes a processor which senses the loss of signal in any electrode channel during a test period and activates an indicator to provide a warning indication.

U.S. Pat. No. 6,142,949 to Ubby issued Nov. 7, 2000 entitled "Lead protection and identification system" discloses a lead protection and identification system for a medical diagnostic device. Electrodes are placed on predetermined locations of a patient, and the system includes clips for attaching to the electrodes. The system identifies a lead and provides information to a user as to which one of the electrodes the lead should be connected to. Potentially dangerous signals are prevented from being inputted to a clip when the clip is not connected to an electrode and prevents the patient from being injured.

United States Patent Publication No. 20030068914 to Merry, et al. published Apr. 10, 2003 entitled "Precordial electrocardiogram electrode connector" discloses an electrocardiogram electrode connector for connecting an electrode to an electrocardiogram device. The connector of the present invention comprises a lower portion having an electrode end and an ECG end, and an upper portion pivotally connected to the lower portion. The upper portion likewise has an electrode end and an ECG end. The connector also comprises a spring between the lower portion and the upper portion to bias the electrode ends together to clamp about an electrode. Further, the connector comprises an electrical assembly having an elastomeric electrical connector to provide electrical continuity between the electrode and the ECG device when the electrode ends of the lower portion and the upper portion of the connector are biased together.

United States Patent Publication No. 20040039275 to Sato, et al. published Feb. 26, 2004 entitled "Biological electrode and connector for the same" discloses a conductive member adapted to be attached onto a living tissue to detect a bioelectrical signal. A retainer retains the conductive member on the living tissue. A lead member is partly brought into contact with the conductive member to lead out the bioelectrical signal to a connector. A waterproof sheet covers the lead member in a watertight manner, while exposing a portion of the lead member from which the biological signal is led out.

United States Patent Publication No. 20040072475 to Istvan published Apr. 15, 2004 entitled "Electrode connector" discloses an electrode connector for connecting a conventional tab electrode or sensor to a lead assembly for use with a physiological data collection system. The electrode connector includes a lead connecting portion for attaching the electrode connector to a lead assembly and a tab connection portion for attaching the electrode connector to a tab electrode or sensor. During use, the electrical signals corresponding to physiological data of the patient pass from the tab electrode or sensor, through the electrode connector, and to the lead assembly.

United States Patent Publication No. 20040106964 to Fischer, et al. published Jun. 3, 2004 entitled "Implantable Medical Device with Multiple Electrode Lead and Connector with Central Fastener" discloses an implantable medical device such as a cardiac stimulator, a multi-electrode lead attached to the device, and a connector coupling the device to the lead. The lead has multiple electrodes, each electrode connected to a wire extending though the lead. The electrodes may be circumferential coils or rings, for example. The lead has a connector that fits into a recess on a surface of the device or apparatus. A bottom wall of the recess has an array of apparatus connections deployed around a threaded bore. The connector is attached to the apparatus by a screw with a threaded shaft and an enlarged head. The screw passes through a central bore in the connector. Electrical connections form a regular pattern, such as a rectangular or square grid, or a radial pattern, around the central bore. A pair of O-rings or seals surround the connections. A gasket, mounted on male connections or contacts, fits around female connections that may be on either the apparatus or the connector.

Despite this broad variety of different designs, none of the foregoing prior art connectors are particularly well adapted to meeting the tandem goals of excellent electrical performance and stability, simplicity of design, low cost, and ease of operation. The prior art solutions (exemplified by those of U.S. Pat. No. 5,895,298 to Faupel discussed above) are either too complex and costly too manufacture, provide poor electrical performance, and/or are not well suited to biomedical applications. Spiraling health care costs further underscore the urgent need for lower cost (and disposable) connector form factors for use in, e.g., ICG/ECG monitoring and evaluation.

SUMMARY OF THE INVENTION

The present invention satisfies the aforementioned needs by providing an improved electrical connector apparatus and associated methods of use and manufacturing.

In a first aspect of the invention, an improved electrical connector apparatus is disclosed. In one exemplary embodiment, the connector apparatus comprises: a unitary spring element having first and second substantially opposing portions, first and second connecting portions coupled to respective ones of said first and second opposing portions, and a variable geometry portion coupled to both said connecting portions and comprising a variable size aperture, said aperture being configured to receive a terminal when properly expanded; and a housing element having first and second movable bias portions, said movable bias portions communicating with respective ones of said opposing portions. The connector is configured such that by biasing at least one of said first and second bias portions, said aperture expands in size.

In another embodiment, the connector comprises: a bias element having a movable portion and a stationary portion, first and second connecting portions coupled to respective ones of said movable and stationary portions, and a variable geometry portion coupled to both said connecting portions and comprising a variable size aperture, said aperture being configured to receive a terminal; and a housing element having a housing bias portion, said movable bias portion communicating with said movable portion of said spring element. When the housing bias portion is biased, said aperture expands in size.

In yet another embodiment, the connector comprises an ultra-low cost device having the unitary conductor (spring) element previously described, along with a flexible and electrically insulating covering disposed over the conductor element. This configuration obviates the rigid housing and actuators of other embodiments, thereby reducing the cost of the connector as a whole (and hence increasing its clinical "disposability").

In a second aspect of the invention, an improved method of manufacturing a connector is disclosed. In one embodiment, the method comprises: providing a conductor element; providing a housing; providing at least one actuator adapted to move within said housing; providing at least one electrical conductor; deforming said conductor element into a shape having at least one bias portion and at least one connection portion having an aperture; disposing said deformed conductor element and said at least one actuator at least partly within said housing; and terminating said deformed conductor element to said at least one electrical conductor.

In a third aspect of the invention, an improved method of operating a biomedical connector is disclosed. In one embodiment, the method comprises: disposing a biomedical electrode in a desired location on a subject; coupling said connector to said electrode; passing at least one electrical signal through said electrode and connector; and removing said connector and said electrode as a unit from said location. A patch electrode having one or more terminals is disposed on the exterior of said subject, and said act of coupling comprises mating said connector onto one of said terminals by applying a substantially normal force to said connector so as to snap it onto the terminal of the patch.

In another embodiment, the biomedical connector has at least two substantially opposing bias portions and at least one fulcrum portion, and the method comprises: biasing said at least two bias portions toward each other so as to expand an aperture proximate to said at least one fulcrum portion, said aperture being shaped to receive said terminal; inserting said terminal at least partly into said aperture; and unbiasing said bias portions, said unbiasing allowing said fulcrum portion to contract said aperture around said terminal.

In yet another embodiment, the connector has a bias element comprising first and second substantially opposing portions adapted to move relative to one another, first and second coupling portions coupled to respective ones of said first and second opposing portions, and a connection portion coupled to said coupling portions and comprising a variable size aperture, and the method comprises: disposing an electrode apparatus having one or more shaped terminals proximate to a living subject; disposing said connector proximate to at least one of said terminals; biasing said connector onto said at least one shaped terminal, said act of biasing comprising expanding said aperture at least temporarily to accommodate a first portion of said shaped terminal and subsequently contracting said aperture to accommodate a second portion of said shaped terminal. After said acts of at least temporarily expanding and subsequently contracting have been completed, said connection portion and said at least one shaped terminal cooperate to maintain said connector in a substantially constant orientation with respect to one another.

In a fourth aspect of the invention, a variable geometry conductor element for forming an electrical connection with a terminal is disclosed. In one embodiment, the contact element comprises: first and second substantially opposing portions; first and second connecting portions coupled to respective ones of said first and second opposing portions; and a variable geometry portion coupled to both said connecting portions and comprising a variable size aperture, said aperture being configured to receive a terminal when properly expanded. Upon biasing at least one of said first and second substantially opposing portions, said aperture expands in size.

In a fifth aspect of the invention, a low-force electrical connector is disclosed. In one embodiment, the connector comprises: a bias element having first and second substantially opposing portions adapted to move relative to one another, first and second connecting portions coupled to respective ones of said first and second opposing portions, and an aperture portion coupled to both said connecting portions and comprising a variable size aperture, said aperture being configured to receive a terminal; and a housing element substantially containing said bias element, said housing having an opening formed therein substantially coincident with said aperture. Upon biasing said connector onto said terminal, said aperture at least temporarily expands in size to receive said terminal in a frictional engagement.

In a sixth aspect of the invention, a biomedical evaluation system is disclosed using the aforementioned connector(s). In one embodiment, the system comprises an impedance cardiography (ICG) device adapted to use the connectors to electrically connect the system to patch-type electrodes disposed on the thorax of the subject being evaluated. In one variant, the signals to and from the various electrodes are passed from and to the system, respectively via a ganged cable element having a plurality of conductors and associated connectors at their distal ends.

BRIEF DESCRIPTION OF THE DRAWINGS

The features, objectives, and advantages of the invention will become more apparent from the detailed description set forth below when taken in conjunction with the drawings, wherein.

DETAILED DESCRIPTION OF THE INVENTION

Figure 1A:
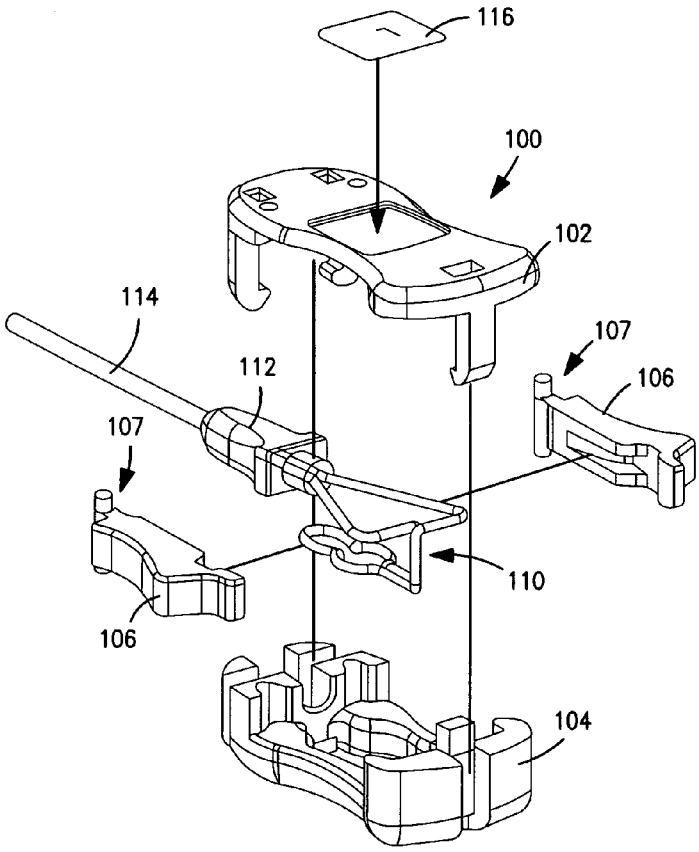
FIG. 1*a* is an exploded perspective view of a first exemplary embodiment of the connector apparatus of the present invention.

Reference is now made to the drawings wherein like numerals refer to like parts throughout.

As used herein, the terms "user", "caregiver", and "clinician" are used interchangeably to refer to a person positioning, using, actuating, or removing the connector or associated components, or practicing the methods disclosed herein, whether for monitoring or treatment of another subject or themselves.

As used herein, the term "biomedical" includes any application for which the transfer of an electrical current or potential is useful in providing treatment or otherwise assessing a biological subject, including without limitation impedance cardiography (ICG), electrocardiography (ECG), and electroencephalography.

As used herein, the terms "subject" and "living subject" refer not only to human beings, but also any other species which may benefit from biomedical analysis, evaluation or treatment.

As used herein, the term "unitary" refers generally to a single functional structure or component, such structure or component which may comprise one or more sub-components.

It will be appreciated that the terms "upper", "lower", "top", "bottom", "front", "rear", and the like are used herein generally to describe position with respect to other components of the invention or associated structures, as opposed to connoting any sort of absolute position, location or relationship. For example, a "lower" housing element may actually be above the "upper" housing element when the connector is installed in an inverted orientation.

Overview

In one salient aspect, the present invention provides an improved connector apparatus for use in biomedical applications such as ICG and ECG monitoring. This connector is optimized for high electrical performance, low manufacturing cost, and ease of operation. In one exemplary embodiment, the connector comprises a single electrical conductor element which is deformed into a shape that allows easy operation by the user (simply be pressing portions of it between their fingers), and is extremely simple to manufacture. The connector firmly engages a corresponding (e.g., "button" type) electrode terminal, and allows for rotation of the connector around the axis of the terminal so to provide operational flexibility to the clinician.

The particular attributes of the shape into which the conductor element is deformed also allow it to be "tuned" to provide the desired physical properties, including in one variant the ability to be snapped onto an electrode terminal without actuating the connector's actuating buttons. Similarly, the connector (when properly adapted) can be removed from the terminal through the proper application of force in a given direction. Hence, the same basic connector form factor can adopt a number of differing physical characteristics as required for each different application.

In another variant, the external housing an actuators of the connector are replaced with a simple flexible covering, thereby even further simplifying the connector and lowering its cost of manufacture.

Detailed Description of the Exemplary Embodiments

Referring now to FIGS. 1*a*–5*d*, a first exemplary embodiment of the connector apparatus of the invention is described. It will be recognized that while described herein primarily in terms of a connector apparatus adapted for biomedical applications such as ICG or ECG, the connector may also readily be adapted to other applications, whether biomedical or otherwise. All such adaptations and alternate embodiments will be readily understood by those of ordinary skill given the present disclosure, and are considered to fall within the scope of the claims appended hereto.

Figure 1B:
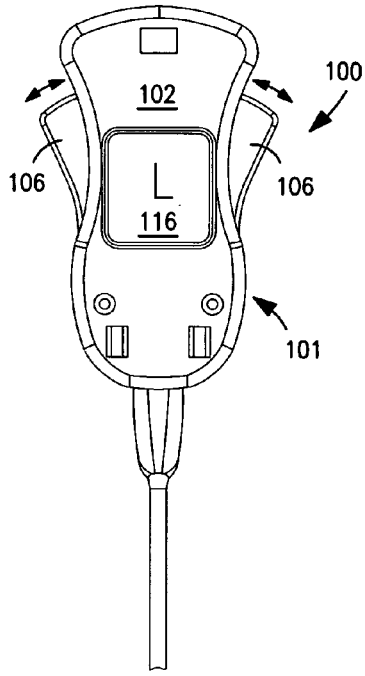
FIG. 1*b* is a top elevational view of the connector of FIG. 1*a*.
Figure 1C:
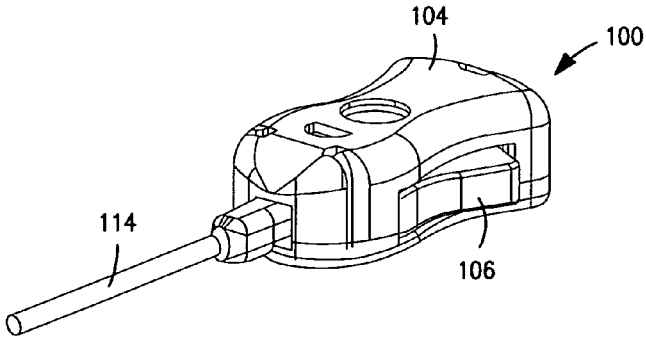
FIG. 1*c* is a bottom perspective view of the connector of FIG. 1*a*.

As shown in FIGS. 1*a*–1*c*, the exemplary connector apparatus 100 generally comprises a substantially symmetric, contoured connector body 101 with an electrical cable 114 issuing from one end thereof. As will be described in greater detail below, the cable 114 provides the electrical interface between the connector 100 and an external system (e.g., ICG or ECG monitoring system, not shown).

The connector body comprises top and bottom connector housing elements 102, 104, as well as two opposed actuator elements 106 which are pivoted at their one end 107 so as to allow the opposing or distal end to move with respect to the housing elements 102, 104. Each of these components comprise a molded polymer such as ABS (acrylonitrile butadine styrene), although other materials such as polyethylene, fluoropolymers (e.g., ETFE), and the like may be used. ABS is selected in the illustrated embodiment for its comparatively high strength and other excellent mechanical properties, as well as comparatively low cost and ease of handling.

Figure 6A:
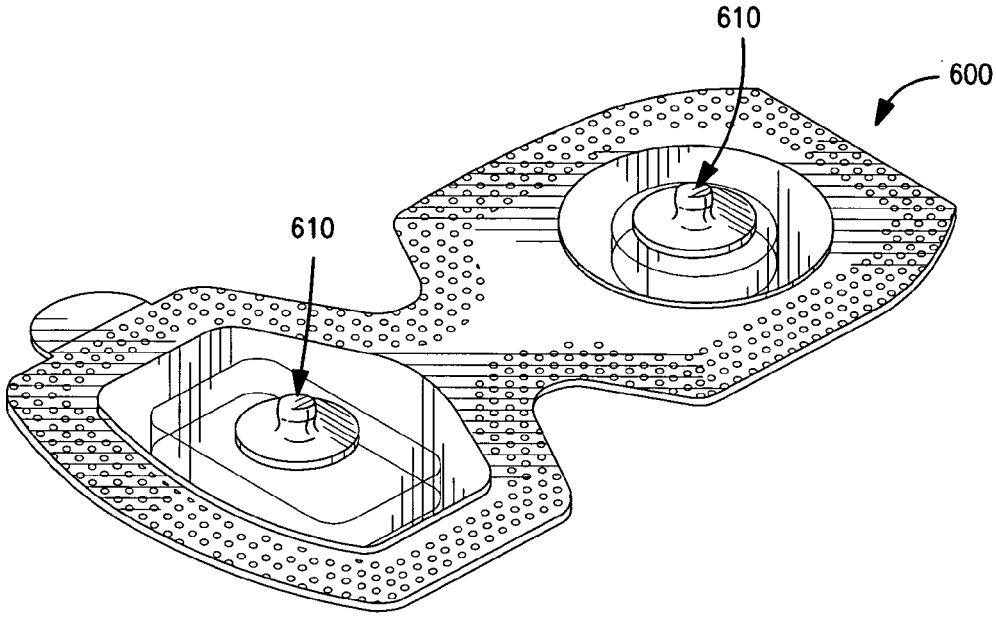
FIGS. 6*a*–6*c* are top perspective, bottom elevational, and side elevational views, respectively, of an exemplary embodiment of an electrode patch useful with the connector of the present invention.
Figure 6B:
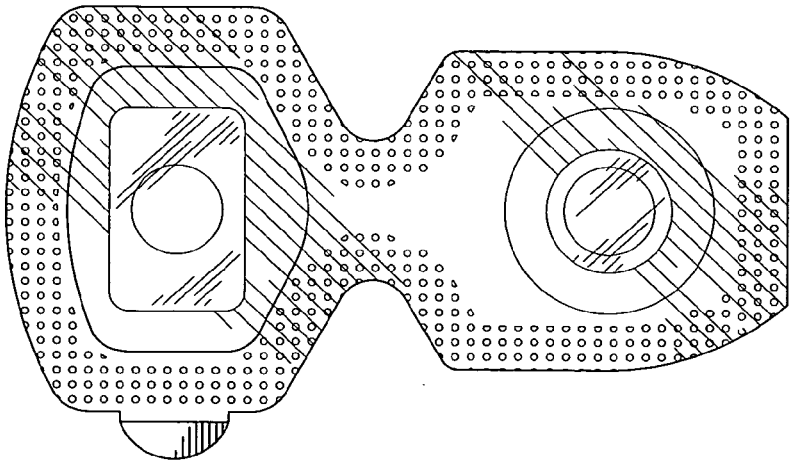
Figure 6C:
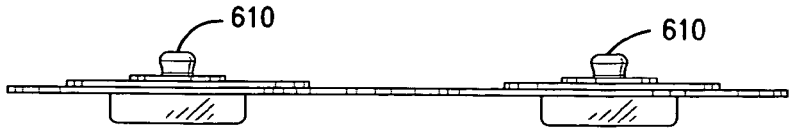
Figure 7A:
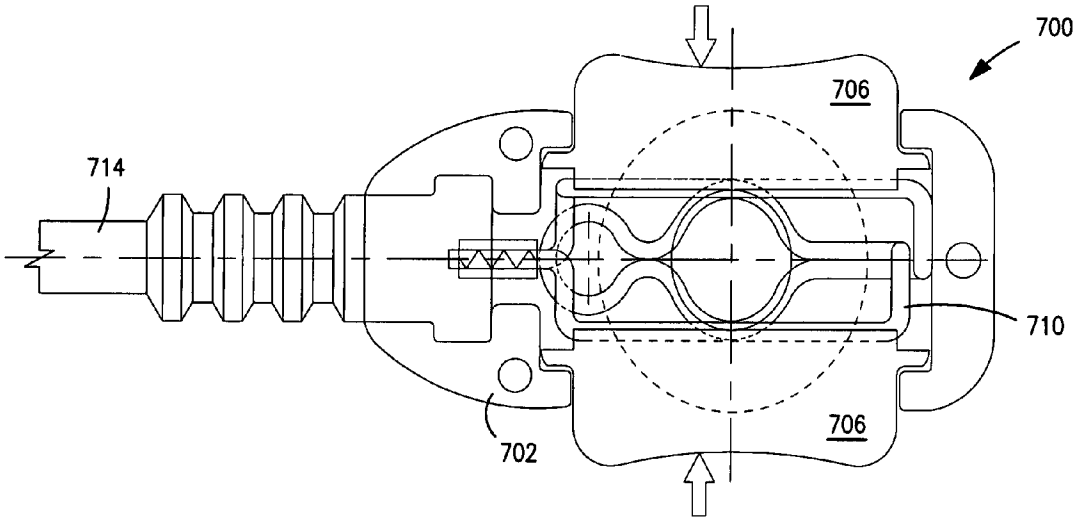
FIG. 7*a* is a top elevational view (partial cutaway) of another embodiment of the connector apparatus of the invention.
Figure 7B:
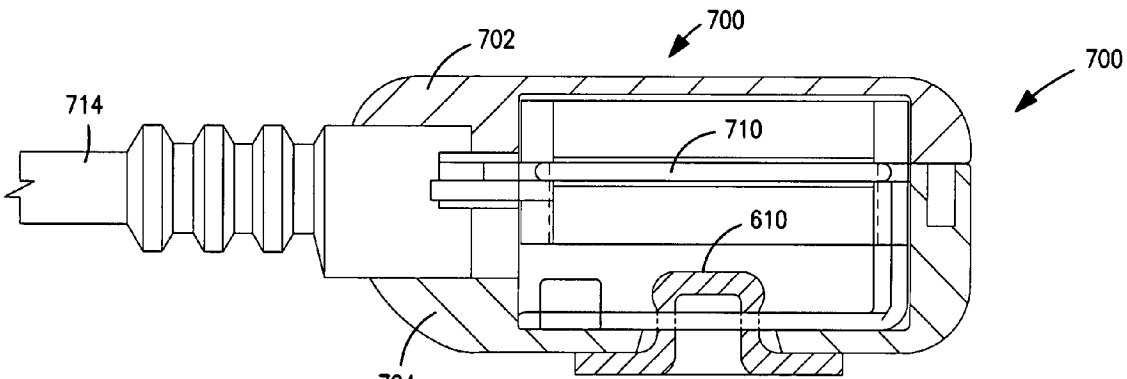
FIG. 7*b* is a side elevational view (partial section) of the connector apparatus of FIG. 7*a*.
Figure 8A:
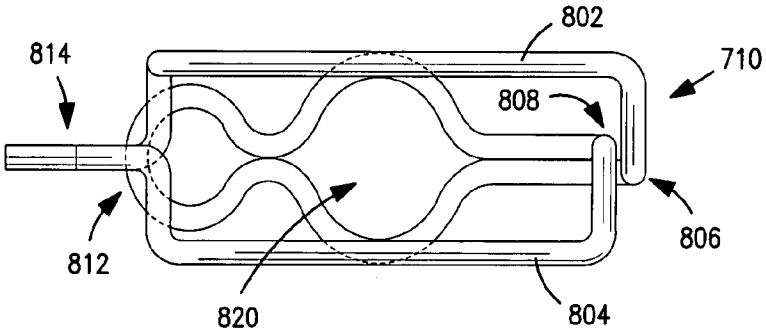
FIGS. 8*a*–8*d* are top, side rear, and front elevational views of the conductor element of the connector of FIGS. 7*a*–7*b*.
Figure 8B:
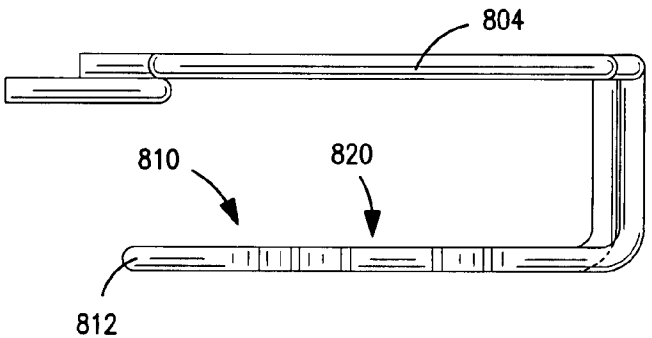
Figure 8C:
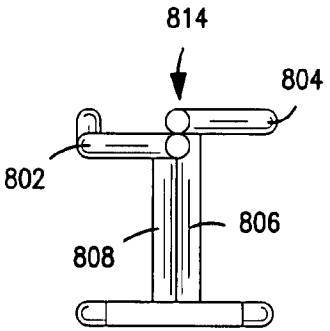
Figure 8D:
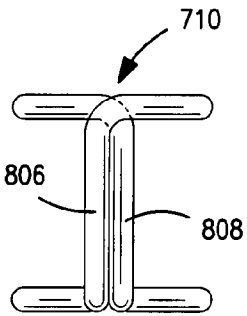

The housing elements 102, 104 when assembled form an interior cavity in which a variable geometry conductor element 110 is received. The conductor element 110 comprises the electrical interface between the conductor(s) of the cable 114 and the electrode terminal 610 (see FIGS. 6*a*–6*c*) to which the connector 100 is mated during use. Herein lies a primary feature of the present invention; i.e., the use of a unitary conductor element which greatly simplifies the connector over prior art designs, and also significantly reduces its cost. Rather than having to form a number of precision components, the conductor element 110 of the illustrated embodiment can be formed simply by properly deforming a single piece of conductor wire. The shape and material of the conductor element 110 cooperate to provide the element with a resiliency when deformed (i.e., "spring" action) without use of any springs or other such components which may ultimately fail or become dislodged under impact or stress. This spring action also provides a very positive engagement between the conductor element 110 and the terminal 610 which it is mated with.

As best shown in FIG. 1*a*, outward portions of the conductor element 110 are received within grooves 506 (FIG. 5*b*) formed on the interior surfaces of the actuator elements 106, thereby allowing force applied to the outer surfaces of the actuators 106 to be transmitted directly to the conductor element 110. As will be described in greater detail below, this force transmission allows the connector to open and close for mating to (or removal from) the electrode terminal 610.

The housing elements 102, 104 of the illustrated embodiment are a "snap-together" type construction, thereby further reducing costs and obviating any fasteners. It will be recognized, however, that such fasteners (either alone or in conjunction with the snap-together functionality), may be used consistent with the invention if desired.

FIGS. 2*a*–2*d* illustrate a first exemplary embodiment of the variable geometry conductor element 110, which is shown without the housing elements 102, 104 or other such components. In this embodiment, the conductor element 110 comprises a single metallic wire having an effective spring constant (when deformed) of k and electrical conductivity $1/\rho$. The metal used for the wire comprises Type 302 Stainless Steel (0.036 in. nominal diameter) having a nickel plating for added ruggedness and low friction. The passivated nature of the stainless steel (i.e., Chromium content) avoids corrosion or oxidation of the conductor element after formation; e.g., while it is sitting on the shelf waiting to be used. Such corrosion or oxidation might cause undesirable changes in the electrical properties of the conductor element, thereby reducing the accuracy and stability of the monitoring system as a whole. This is especially true considering the relatively small electrical potentials being measured in the typical ICG or ECG system. Furthermore, such corrosion and oxidation can increase the roughness of the surface of the conductor element 110, thereby providing increased resistance to rotation of the connector 110 around the terminal 610 during use.

The illustrated conductor element 110 is formed from a wire having a substantially circular cross-section. This shape is selected for a variety of reasons, including (i) a smooth, low friction interface with the rounded terminal head; (ii) symmetry in deformation (i.e., so as to avoid any issues relating to particular handling orientations of the wire blank used to form the conductor element; and (iii) minimizing creation of stress risers on the deformed wire which may result in premature failure (e.g., under high cyclic or fatigue loading). Stated simply, a round wire can be most easily handled, and will generally have the lowest friction and highest reliability.

The aforementioned circular cross-section, in conjunction with the substantially rounded head and skirt region of the terminal 610, allows the conductor element 110 (and hence connector 100) to rotate around the terminal axis without encountering significant friction or galling the terminal skirt.

It will be appreciated, however, that other materials and cross-sectional profiles may be used for the conductor element 110. For example, another alloy such as Cu—Ni or Inconel (Ni—Cr—Fe), plated or unplated, may be used with the same or another profile (such as octagonal or hexagonal). A square or rectangular cross-section may even be used with proper handling. Myriad other variations and combinations are possible, as will be recognized by those of ordinary skill in the metallurgical arts.

As previously noted, the shape of the conductor element 110 is specially selected to provide a number of functions and features, including inter alia: (i) spring action which returns the element 110 to its original shape after being biased; (ii) a multi-planar configuration such that the bias portions 202, 204 of the conductor element 110 are disposed in a plane different than the terminal-receiving aperture 220 which receives the electrode terminal 610; (iii) significant lateral and longitudinal space conservation (thereby allowing the connector 100 to be smaller); (iv) the creation of a loop fulcrum 212 which allows the aperture 220 to expand and contract with relatively minimal bias force, yet which keeps the terminal securely engaged within the aperture when no bias force is applied.

Figure 2B:
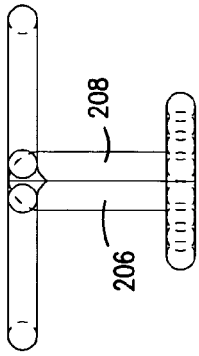
FIG. 2*b* is a front elevational view of the conductor element of FIG. 2*a*.
Figure 2A:
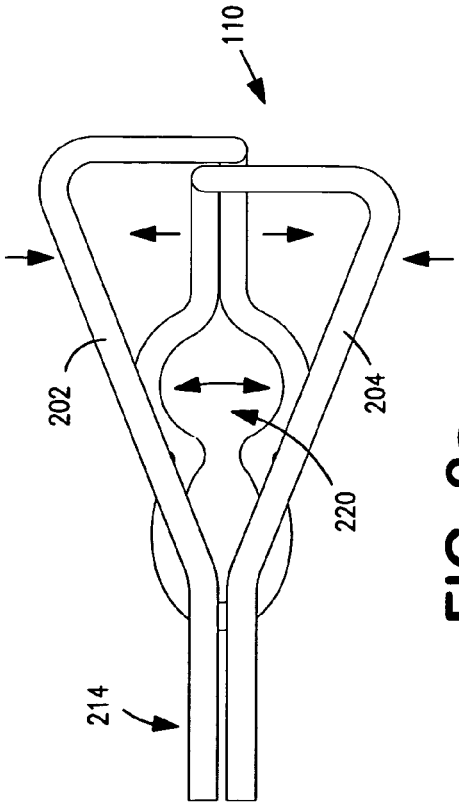
FIG. 2*a* is a top elevational view of a first embodiment of the variable geometry conductor element useful with the connector of FIGS. 1*a*–1*c*.
Figure 2D:
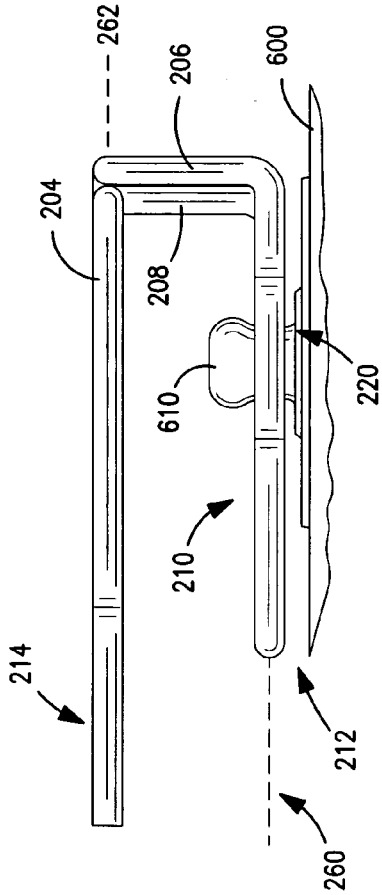
FIG. 2*d* is a side elevational view of the conductor element of FIG. 2*a*, showing a button-type electrode terminal received therein.
Figure 2C:
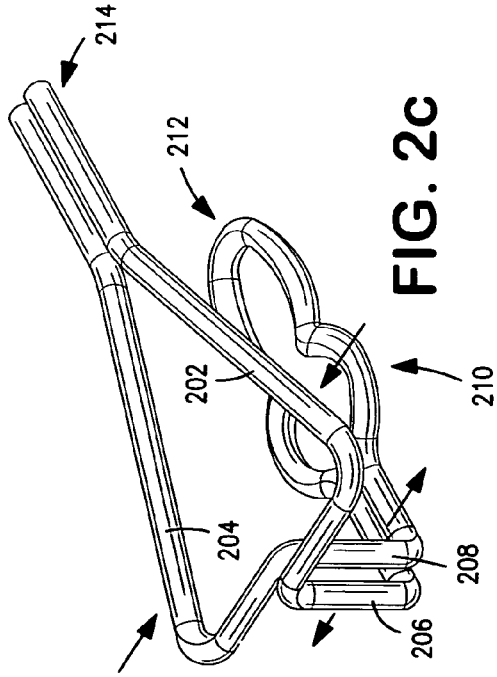
FIG. 2*c* is a top perspective view of the conductor element of FIG. 2*a*.
Figure 3B:
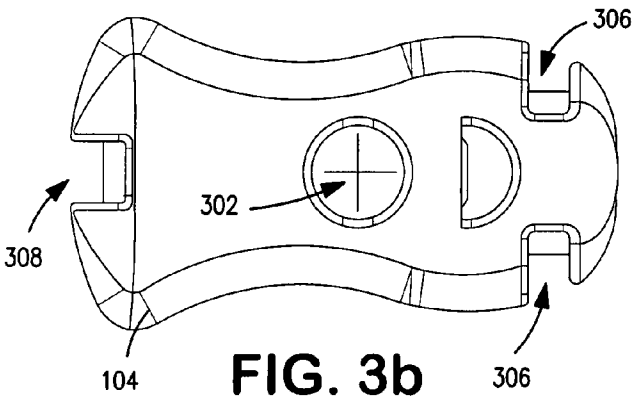
FIGS. 3*a*–3*d* are top, bottom, side, and front elevational views, respectively, of the exemplary bottom housing element of the connector of FIGS. 1*a*–1*c*.
Figure 3C:
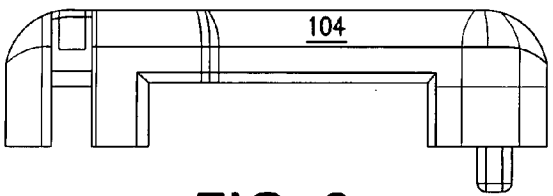
Figure 3D:
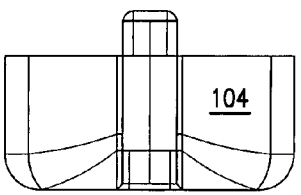
Figure 3A:
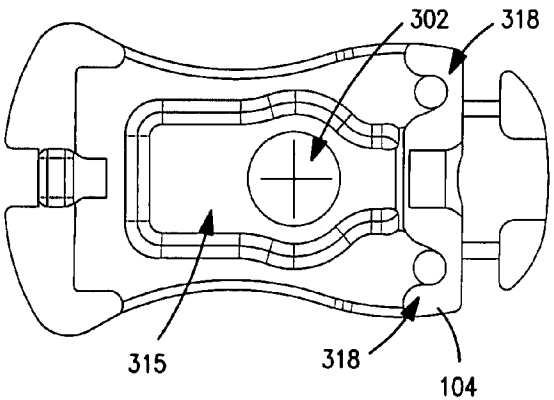
Figure 3E:
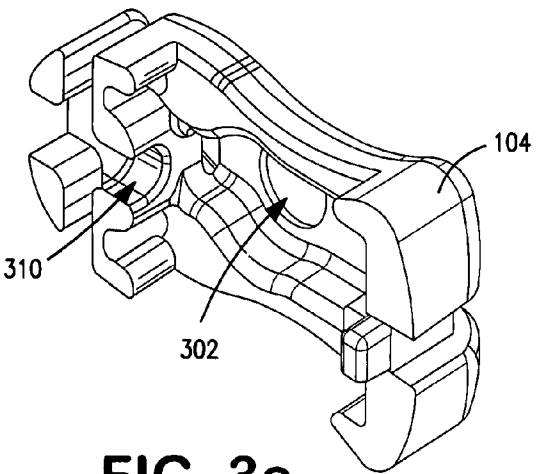
FIG. 3*e* is top perspective view of the exemplary bottom housing element of the connector of FIGS. 1*a*–1*c*.
Figure 4A:
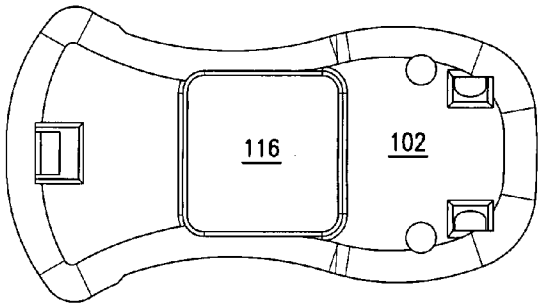
FIGS. 4*a*–4*d* are top, bottom, side, and front elevational views, respectively, of the exemplary top housing element of the connector of FIGS. 1*a*–1*c*.
Figure 4B:
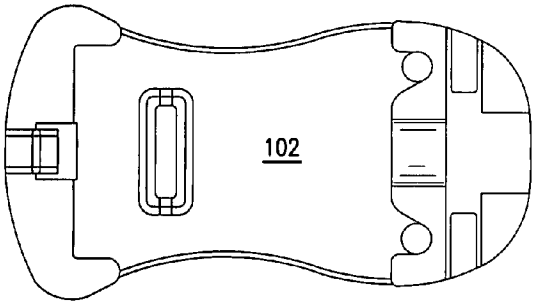
Figure 4C:
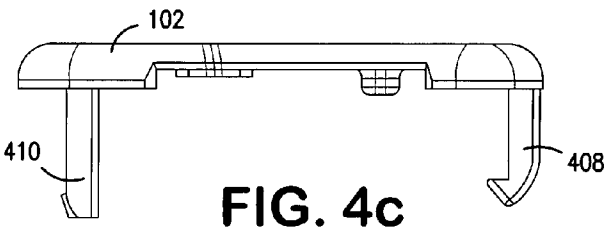
Figure 4D:
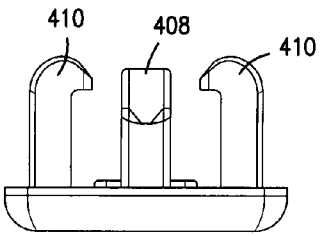
Figure 4E:
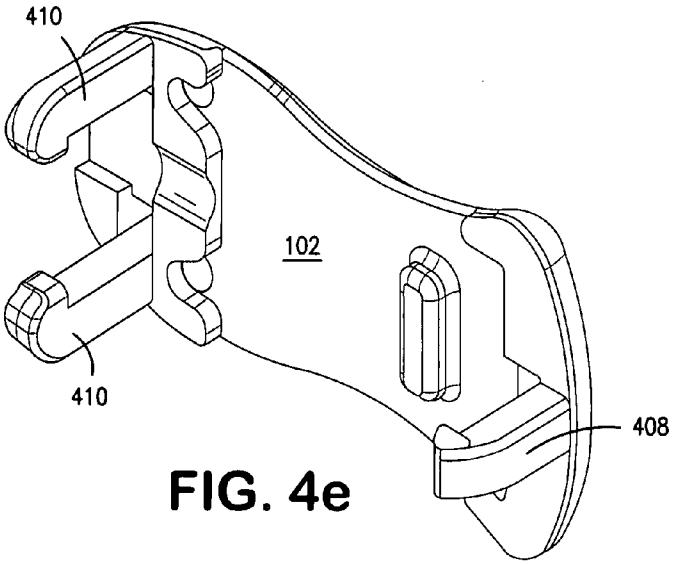
FIG. 4*e* is a bottom perspective view of the exemplary top housing element of the connector of FIGS. 1*a*–1*c*.

As further shown in FIGS. 2*a*–2*d*, the exemplary embodiment of the conductor element 110 is comprised generally of a connection portion 210 set on a lower plane 260 of the element 110, and a bias or actuation portion set on an upper plane 262 of the element 110. This multi-planar approach allows the connector to be spatially efficient, since the terminal head 610 is received within the volume formed between the two planes 260, 262 as shown in FIG. 2*d*. The difference in elevation between these two planes 260, 262 (which need not be parallel in orientation) is controlled substantially by the connecting portions 206, 208 of the element 110, which in the illustrated embodiment are substantially perpendicular to both planes 260, 262. It will be recognized, however, that these connecting portions may assume literally any shape, and need not per perpendicular or vertical in orientation.

Furthermore, the exemplary conductor element 110 "loops back" on itself, thereby minimizing the overall length of the element 110. It will also be noted that the overall diameter of the element 110 (when viewed from above as in FIG. 2*a*) is minimized, with the compressed diameter being even smaller than that of the uncompressed (unbiased) state. There is also a good correspondence between the points of application of the bias force 202, 204 and the center of the aperture 220, thereby avoiding the situation where the bias force is longitudinally offset from the aperture (which would make operation of the connector mechanically awkward).

The use of a unitary component for the element 110 also reduces weight, since no supporting, interfacing, or bonding components are needed to provide the various functions of the element 110. However, in any of the embodiments of the present invention, it will be appreciated that the variable geometry conductor element 110 may also be composed of more than one piece of wire. For example, the conductor element 110 may comprise a plurality of wires bonded or otherwise coupled together, such as in a stranded or rope-lay fashion. Alternatively, the materials and/or physical properties and dimensions of the conductor element may vary over its length, whether through use of a unitary ("raw") blank or one composite in nature. For example, where it is desired to have different materials form the bias portions 202, 204 and opposed to the lower connection portion 210, the two components can be joined (e.g., at the connecting portions 206, 208) via welding, brazing, etc. It will be appreciated that the connection portions 206, 208 and even other portions of the conductor element 110 are not critical in terms of strength or fatigue resistance, and hence a sturdy joint can be tolerated if desired.

FIGS. 3*a*–3*e* illustrate the exemplary bottom housing element 104 of the connector 100 of FIG. 1*a*. As previously described, this housing element comprises an ABS or comparable material molded to the desired shape. This shape includes a central aperture 302 for receiving the terminal 610 therein during use, as well as a channel 310 adapted to place and retain the conductor element 110 and its terminated cable 114. Two pivot points 318 (e.g., recesses to receive the actuator element pins 502 described subsequently herein with respect to FIG. 5) are also provided in order to facilitate the desired rotation of the actuator elements 106 within the housing body 101. An interior volume 315 or basin is also formed within the housing element 104 in order to seat and retain the conductor element 110 when received in the housing.

FIGS. 4*a*–4*e* illustrate the exemplary configuration of the top housing element 102 of the connector 100 of FIG. 1*a*. As shown in the Figures, this component 102 comprises a generally planar structure having a plurality of snap risers 408, 410 which correspond to the grooves 308, 306 formed in the bottom element 104, such that the two housing elements 102, 104 snap together. The top housing element 102 also includes two pivot features 418 which receive the tope ends of the pins 502 of the actuator elements 106, comparable to those for bottom element 104 previously described. The outer surface of the of top element 102 also contains a recess 117 which can optionally receive a label 116 or other indication mechanism. For example, the label 116 might be used to identify the connector placement (e.g., "L" for Left, "R" for right), or otherwise provide instructions on use, cautions/warnings, manufacturer information, compatibility information, expiration date of the connector, etc.

Figure 5C:
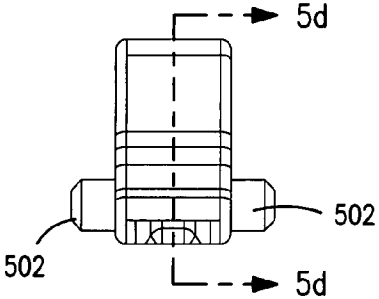
FIGS. 5*a*–5*c* are top, side, and front elevational views, respectively, of the exemplary actuator element of the connector of FIGS. 1*a*–1*c*.
Figure 5D:
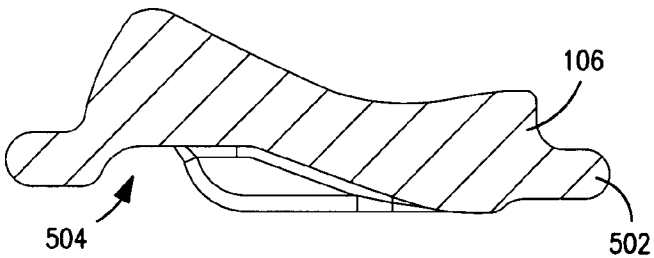
FIG. 5*d* is cross-sectional view of the exemplary actuator element of the connector of FIG. 5*c*, taken along line 5*d*–5*d*.
Figure 5A:
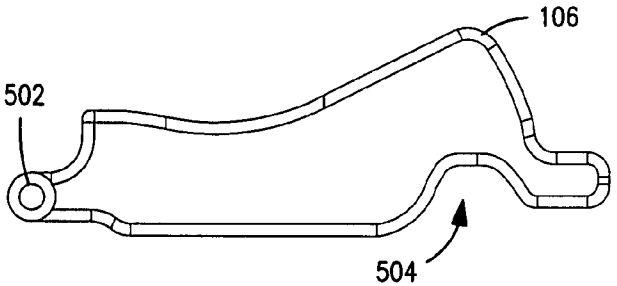

FIGS. 5*a*–5*d* illustrate an exemplary configuration of the actuator elements 106 of the connector of FIG. 1. As shown in FIG. 5*a*, the actuators 106 each comprise a molded (e.g., ABS) arm with a pivot pin 502 at one end and an eccentric load-bearing region towards the other end. The load-bearing region includes a projection which is used by the operator to bias the conductor element 110 together, as subsequently described herein.

Figure 5B:
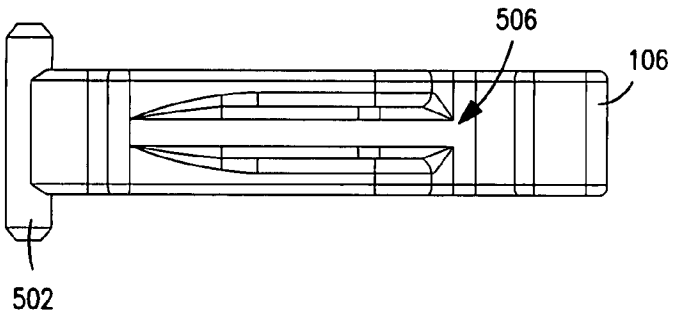

As shown in FIG. 5*b*, the interior surface of the actuator arm 106 includes a slot or groove 506 which is adapted to receive the respective bias portion 202, 204 of the conductor element 110 therein. This relationship helps retain the conductor element 110 in the proper orientation within the connector housing body 101, and provides a firm and tightly coupled interface between the actuators 106 and the bias portions 202, 204 to prevent the latter from moving significantly with respect to the former when a bias force (load) is applied to each actuator 106 during use. Note also that the housing elements 102, 104 are configured such that their rigid coupling to one another, and the receipt of the pins 502 within their respective recesses 318, 418, provide actuators 106 with a stable platform for biasing the bias portions of the conductor element 110. Stated simply, the actuators 106 are prevented from skewing within the housing body 101 during loading by the cooperation of these various design features.

FIGS. 2*d* and 6*a*–6*c* illustrate one exemplary embodiment of an electrode patch 600 that can be used consistent with the invention. It will be appreciated that the connector of the present invention can be used with literally any type of electrode or terminal shape, so long as it fits within the aperture 220 of the conductor element 110 when the latter is compressed. While a button-type or shaped terminal 610 is illustrated, the invention can operate with other terminal profiles, and clearly can be scaled as necessary to accommodate different sizes of terminals. Furthermore, the cross-sectional profile of the conductor element 110 wire can be varied so as to optimize the interface between the selected terminal profile and the connector, as described elsewhere herein.

In the illustrated embodiment, the exemplary electrode terminal element 610 (FIGS. 2*d* and 6*a*–6*c*) comprises an electrically conductive material such as extruded metal or metal-coated polymer, and having a top or head portion that is larger in diameter than the middle or skirt portion. The electrodes also include a conductive interface (e.g., gel shape) on its lower face to provide an electrical interface between the upper terminal 610 and the subject being monitored. Exemplary configurations of such "spot" electrodes particularly useful with the invention herein are described in U.S. Pat. No. 6,636,754 to Baura, et al. issued Oct. 21, 2003 and entitled "Apparatus and method for determining cardiac output in a living subject" as well as in U.S. design Pat. Nos. D475,138 entitled "Electrode for use on a living subject with removable protective electrode carrier", and Nos. D471,281 and D468,433 each entitled "Electrode for use on a living subject", each of the foregoing assigned to the Assignee hereof and incorporated by reference herein in its entirety.

FIGS. 7*a*–8*d* illustrate another embodiment of the connector apparatus 700 of the invention. As shown, this embodiment comprises two directly opposed actuators 706 which act against corresponding bias portions 802, 804 of the conductor element 710. Here, the conductor element 710 uses two substantially parallel bias portions 802, 804 as opposed to the divergent configuration of the element 110 of FIGS. 2*a*–2*d*. The general operating principles of the is element 810 are the same, however. Notably, the actuators 706 of the present embodiment are not pivoted per se, but rather travel linearly inward and outward from the connector 700 during use, their alignment maintained substantially by the surrounding portions of the housing 702, 704 and the bias portions 802, 804 of the conductor element 110.

"Snap" Variants

In another aspect, an exemplary streamlined apparatus and method of operating the connector(s) described herein are disclosed. Specifically, typical biomedical (e.g., ICG) electrodes such as those of U.S. Pat. No. 5,895,298 discussed previously herein require affirmative actuation of the connector (e.g., depressing the buttons on the sides) for both attachment and removal of the connector to the electrode terminal. In an alternate embodiment of the present invention, the connector is configured so as to permit a rapid "snap on" to the electrode terminal simply by the application of sufficient downward force (e.g., by the user grasping the connector housing, placing the bottom terminal aperture over the head of the terminal, and pressing down). This functionality is somewhat akin to a snap button on a garment or the like, and is facilitated through the use of a conductor element having a rounded (e.g., circular, elliptical, or similar) cross-section in the region where it engages with the (rounded) head of the terminal 610 (see FIGS. 2*d* and 6*c*). Specifically, as the user presses downward on the connector housing, the aperture of the connection portion 210 of the conductor element 110 is opened slightly by the terminal head acting to spread the aperture as the terminal 610 penetrates. The rounded, substantially smooth surfaces of the terminal head and the conductor element 110 facilitate reduced friction, and sliding of the components past one another. Once the conductor element aperture is expanded sufficiently, the broadest portion of the head or the terminal 610 is passed through the aperture 220, and the connection portion 210 and aperture 220 contract around the shank or skirt of the terminal 610, thereby locking the terminal in place within the conductor element 110.

It will be appreciated that the geometry, materials, and/or dimensions of the conductor element 110 may be selected so as to provide literally any degree of desired compliance. Hence, for the typical biomedical application, it would be desirable to configure the connector such that only a fairly minimal downward force or normal is required to cause the terminal head to penetrate the aperture 220 and be fully engaged therein. This minimal force profile helps prevent any bruising or other deleterious effects which may result from the excessive application of pressure to an electrode that is already disposed on the subject being monitored.

It is also noted that since the conductor 110 (and hence connector 100) can rotate around the skirt or shank of the terminal 610 without reducing electrical continuity, the force applied by the contact portions of the conductor element 110 forming the aperture 220 against the terminal skirt need not be as high as might otherwise be required if the connector were not allowed to rotate. For example, where a patient or clinician inadvertently tugs or jerks the conductor wire 114, the connector 110 will rotate around the terminal shaft as needed to help mitigate the stress, while still maintaining electrical continuity. The connector 110 would rather rotate around the electrode terminal than dislocate the terminal out of the aperture, at least in most cases.

Obviously, the actuator buttons may also be retained on this device so as to provide a fully manual mode (i.e., where the user does not want to exert any appreciable downward force on the subject, or the terminal post head is not sufficiently rounded to permit easy "snap-on" engagement). Alternatively, the actuator buttons 106 can be completely obviated in favor of a purely snap-on/snap-off functionality, thereby reducing cost of the connector. The "hybrid" variant of FIGS. 9–9*a* discussed elsewhere herein may also be used in this regard; this configuration is the nexus of low cost (i.e., no actuator buttons 106 and a low cost pliable housing) and actuator functionality (i.e., the sides of the connector body can be depressed to actuate the connector as previously described with respect to the embodiment of FIG. 1*a*).

In terms of removal of the "snap-on" device, the user can use any number of approaches. In one variant, the user simply actuates the button(s) on the connector (or depresses the sides in the case of the variant of FIG. 9) to expand the aperture 220 and allow removal of the connector from the terminal stud 610.

Alternatively, the user can simply remove the connector and the electrode patch as a unit, such as by grasping the connector and applying a torsional and/or shear stress to the connector (without actuating the buttons) so as to dislodge the patch from being adhered on the subject. Similarly, the user can pull up one corner of the patch, with connector attached, and then simply peel up the remainder of the patch.

As yet another alternative, the connector (where properly adapted) can be rotated out of the plane of its normal orientation (i.e., out of a plane roughly parallel with that of the electrode patch 600) so as to slightly distort the conductor element 110 of the connector to open sufficiently in order to remove the terminal 610. As will be noted by inspection of FIGS. 2*a*–2*d*, the longitudinal axis of the connection portion 210 of the conductor element 110 represents a path of least resistance for expanding the aperture 220. Hence, if the user rotates the connector out of the aforementioned normal orientation along this axis, such as by grasping the conductor wire and pulling upward and forward toward the front of the connector housing body 101, the conductor element 110 within the connector 100 will be in effect pried open by the terminal head 610 acting against the sides of the aperture 220 (assuming the electrode patch is sufficiently restrained during the prying action). If the conductor element 110 is sufficiently compliant, this removal can be accomplished with fairly minimal force. Hence, especially in embodiments of the connector where no actuator buttons are present, this mode of removal may be readily used.

One-Button Variants

It will be appreciated that while the foregoing embodiments of the connector apparatus of the invention generally employ two (2) opposing actuators or buttons, the connector apparatus may be practiced with equal success using one (1) button, or even no (zero) buttons. Specifically, in the case of the one-button variant, the conductor element 110 merely requires sufficient biasing force to move the two opposing members 202, 204 toward one another so as to open the aperture 220. Since only relative motion between the two opposing portions 202, 204 is required, one of the portions can be in a substantially fixed disposition (e.g., seated within a recess or groove on the interior of the housing body 101), while the other opposing portion 202, 204 is actuated by an actuator 106 (e.g., button or the like) as previously described. The compressive bias force is generated as the user squeezes the one side of the housing body 101, and the single actuator 106 on the other side of the body 101, together. The penetration 302 in the lower housing 104 can be made slightly larger to accommodate the small degree of lateral translation of the aperture 220 of the conductor element 110 in such a configuration. This approach even further simplifies and reduces the cost of the connector 100.

Ultra-Simplified Variants

Figure 9:
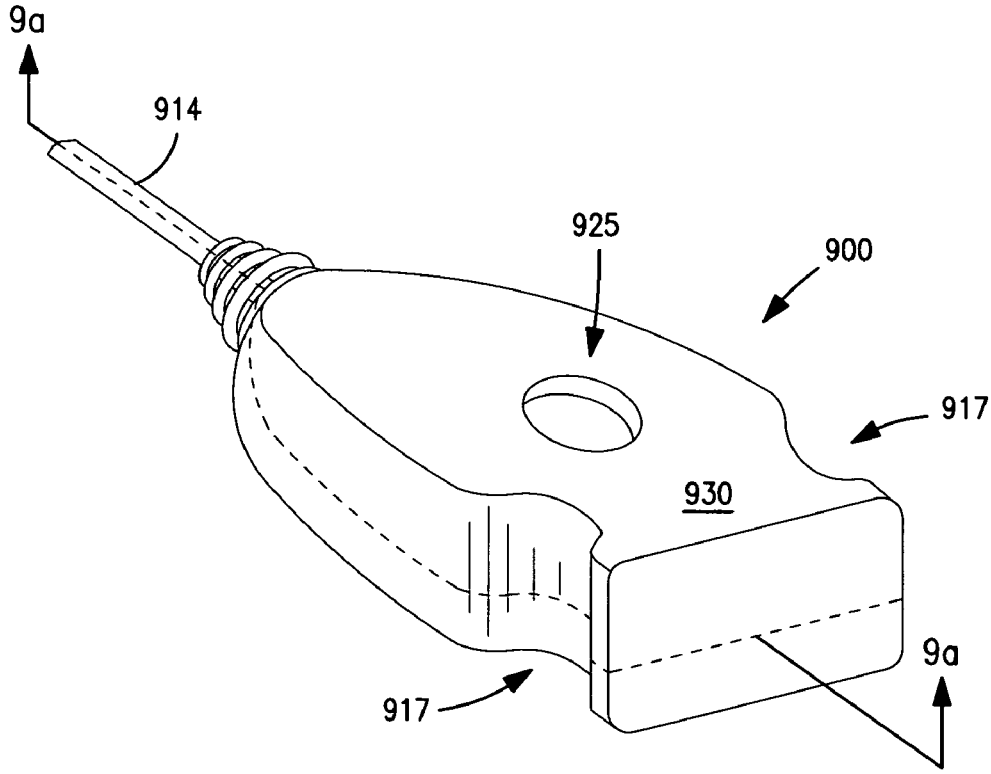
FIG. 9 is a bottom perspective view of yet another embodiment of the connector apparatus of the invention, illustrating the use of a flexible covering.
Figure 9A:
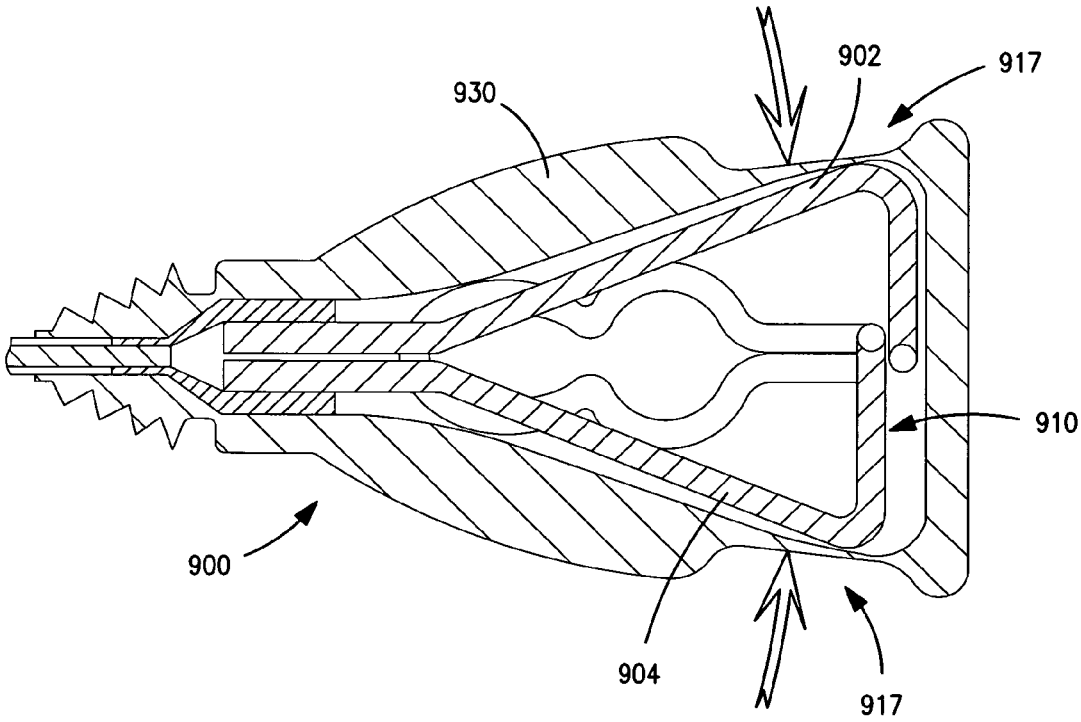
FIG. 9*a* is a cross-sectional view of the connector of FIG. 9, taken along line 9*a*–9*a*.

Referring now to FIGS. 9–9*a*, yet another exemplary embodiment of the connector apparatus 900 of the invention is described. As shown in FIGS. 9–9*a*, the connector 900 comprises a central variable geometry conductor element 910 similar to that of FIGS. 2*a*–2*d* (or 8*a*–8*d*) disposed within a simplified molded-on or pliable housing jacket 930. The housing jacket 930 purposely has no actuator elements 106, yet replaces these with finger recesses 917 disposed proximate to the bias portions 902, 904 of the conductor element 910. The user then simply biases the finger recesses 917 inward against the bias portions of the conductor element, thereby actuating the latter. The thickness of the covering 930 in the region of the bias portions 902, 904 can be adjusted as desired in order to make the connector 900 easy to operate yet provide sufficient electrical performance (including insulation level between the user and the conductor element 910). An aperture 925 is formed in the bottom of the covering coincident with the aperture 920 of the conductor element 110 so as to permit ingress and egress of the terminal 610. A cable 914 with molded strain relief is also provided.

This configuration 900 provides an extremely low cost solution yet retains the general functionality of the connector 100 of FIG. 1*a*. It can also be adapted for "snap-on" operation as previously described herein if desired.

Method of Manufacture

Figure 10:
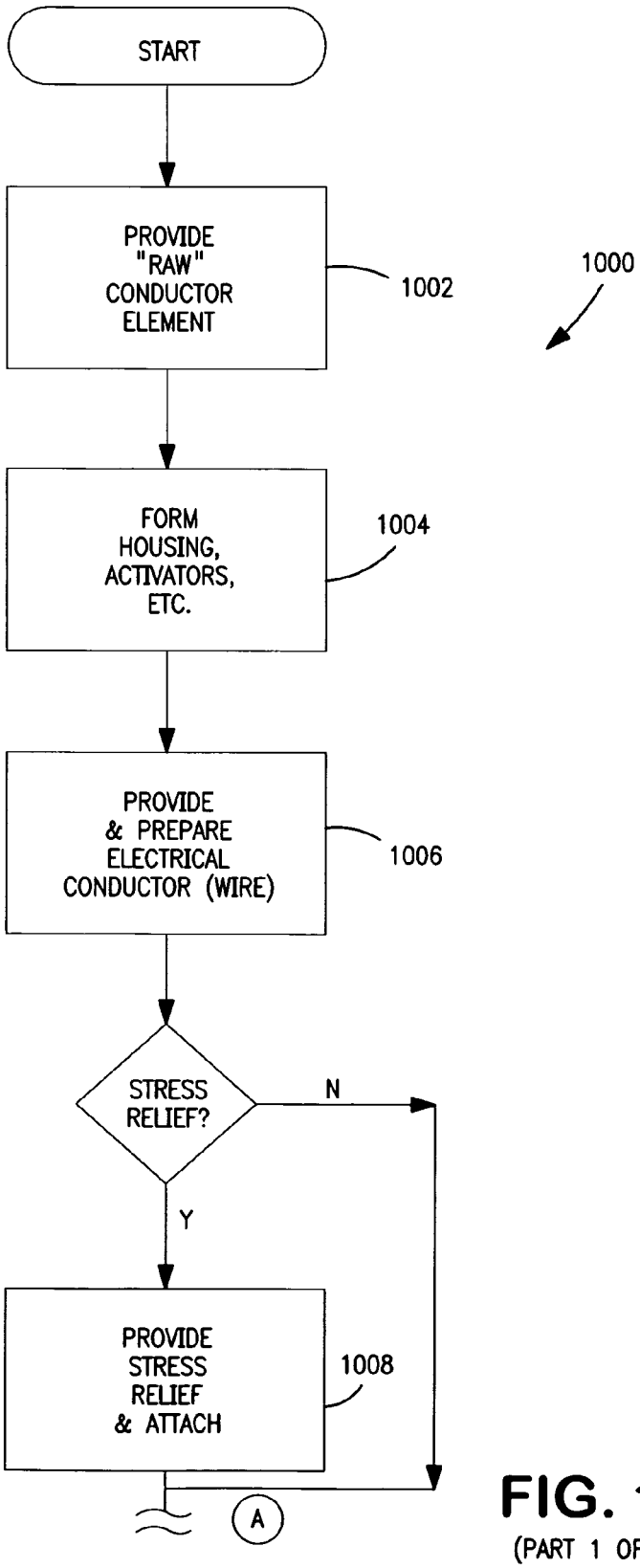
FIG. 10 is a logical flow diagram illustrating one exemplary embodiment of the method of manufacturing the connector apparatus according to the invention.
Figure 10:
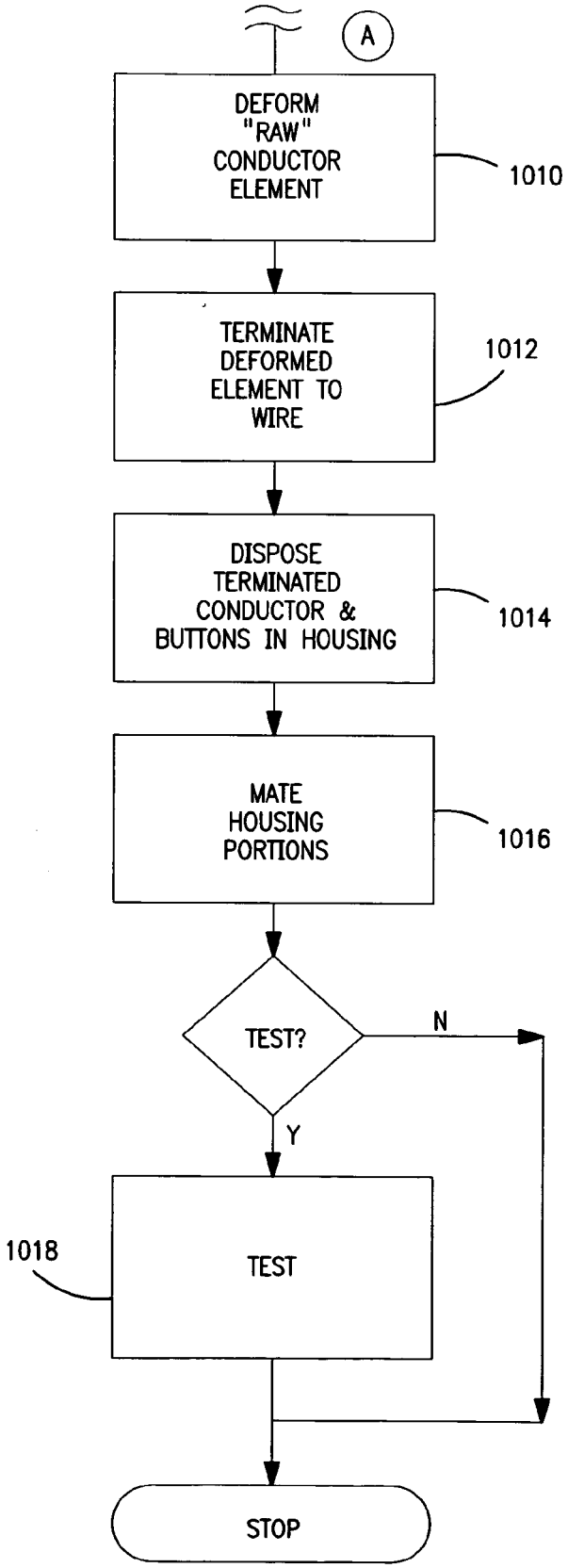

Referring now to FIG. 10, an exemplary embodiment of the method of manufacturing the connector of the present invention is described in detail. It will be appreciated that while the following method is described primarily in terms of the connector embodiment of FIGS. 1*a*–5*d*, the method can be readily adapted to any of the embodiments shown herein (and in fact others) by those of ordinary skill in the manufacturing arts.

As shown in FIG. 10, the method 1000 comprises first providing a conductor element 110 (step 1002). As previously described herein, the conductive element comprises a metallic (e.g., alloy) conductor having a selected cross-section (e.g., round, elliptical, rectangular, etc.). In step 1004, one or more housing components 102, 104 are formed, such as via a molding process (e.g., injection, transfer, or the like). Included within the housing components are the actuator elements 106 (e.g., buttons).

Per step 1006, an electrical conductor 114 (e.g., an insulated 24 AWG wire having one or more individual conductor strands) is provided. This conductor may also be prepared by stripping the insulation from one end to facilitate subsequent termination to the conductor element 110. A stress relief device 112 is also optionally attached to the conductor 114 in preparation for subsequent assembly of the housing per step 1008.

Next, per step 1010, the conductor element 110 is deformed into a shape having the bias portions 202, 204 and at least one connection portion 210 (including the aperture 220) as previously described herein. This deformation is accomplished via a bending machine or other such process well known in the manufacturing arts. When completed, this step 1010 produces a conductor element such as that shown in FIGS. 2*a*–2*d* or 8*a*–8*d* (or even another configuration, depending on the particular application).

Once the conductor element 110 has been deformed, it is then terminated to the electrical conductor (wire) 114 per step 1012 using any number of well known termination processes including, e.g., soldering, brazing, welding, crimping, wire wrapping, etc. The conductor element 110 may optionally be notched, have a loop or terminal, serrated teeth, etc. to further facilitate positive electrical and mechanical engagement between the wire and the deformed element 110.

Next, the deformed and terminated conductor element 110 is disposed within the bottom housing 104 with the actuator button(s) 106 per step 1014. As previously described, the actuator buttons 106 are configured to engage their corresponding bias portions 202, 204 of the conductor element, such as by having these portions fit within a slot 506 formed within the interior surface of the actuators 106. The actuators 106 are also optionally fitted with a pivot structure (e.g., opposed pins 502) that engage corresponding portions of the housing 102, 104 so as to permit the buttons to move pivotally with respect to the housing portions 102, 104.

Hence, when assembling the conductor element 110 (with stress relief and cable), the housing body 101, and actuators 106, the actuators 106 are first fit onto the conductor element, and then the assembly disposed into one half (e.g., lower portion 104) of the housing body 101, such that the components each fit into their proper features within the lower housing 104.

Lastly, per step 1016, the top portion of the housing 102 is positioned over top of the lower portion 104 which contains the aforementioned components, and the two housing components 102, 104 mated so as to capture the various components within the housing body 101. In the exemplary embodiment, this capturing comprises snapping the two housing components together using the molded-in locking tabs 408, 410 and corresponding recesses 308, 306 to keep them in a firm cooperation; however, the housing portions 102, 104 can also be held in the desired relative position using adhesives, threaded fasteners, rivets, friction or heat-staked pins, metal clips, or any number of other mechanisms well known to those of ordinary skill in the mechanical arts.

The assembled connector may then be mechanically tested (step 1018); e.g., by actuating the buttons, straining the strain relief, etc. The connector can be electrically tested as well; e.g., by mating the connector to a terminal or other electrically conductive device and performing electrical continuity or resistance testing thereof. For example, since the electrical characteristics of the connector are potentially critical in certain applications, the connector may be mated to an actual electrode of the type with which it will be used (e.g., ICG "patch" or spot electrode) and tested in this fashion, thereby most closely approximating actual operating conditions. The conductor 114 (or even the connector itself) may also be tested for voltage withstand or other electrical, mechanical or insulating properties. Myriad other testing and/or quality assurance techniques may be applied as desired.

In an alternate embodiment of the method, the housing is molded or otherwise disposed over top of the deformed conductor element 910 as previously described with respect to FIGS. 9–9*a*. Specifically, in one variant, the actuators 106 of FIG. 1*a* are obviated in favor of a substantially flexible covering 930 (such as a PVC, elastomer, or other such material) that permits the user to apply inward bias pressure directly to the bias portions of the conductor element simply by grasping the two recesses 917 formed in the covering 930. Hence, during manufacturing, the flexible covering is applied after the deformed conductor element 910 has been terminated to the cable, such as by either (i) pre-forming the covering and stretching it over the conductor element 910, or (ii) molding the covering 930 directly onto the conductor element/wire assembly. Such techniques (and other comparable approaches) are well known to those of ordinary skill in the manufacturing arts, and hence not described further herein.

It will be recognized that while certain aspects of the invention have been described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. A low-cost simplified electrical connector adapted for use with biomedical patch-type electrodes having at least one button-shaped terminal, comprising:

a unitary substantially metallic spring element having:

first and second substantially opposing bias portions;

first and second connecting portions coupled to respective ones of said first and second opposing portions;

a variable geometry portion coupled to both said connecting portions and comprising a variable size aperture and a fulcrum portion, said aperture being configured to receive one of said button-shaped terminals when properly expanded; and a housing element having first and second movable actuation elements, said movable actuation communicating with respective ones of said opposing portions;

wherein upon biasing at least one of said first and second movable actuation elements, said aperture expands in size; and wherein upon unbiasing said at least one movable actuation elements, said aperture contracts in size due at least in part to spring force generated by said fulcrum portion.

2. An electrical connector, comprising:

a bias element having:

a movable portion and a stationary portion;

first and second connecting portions coupled to respective ones of said movable and stationary portions;

a variable geometry portion coupled to both said connecting portions and comprising a variable size aperture, said aperture being configured to receive a terminal; and a housing element having a housing bias portion, said movable bias portion communicating with said movable portion of said bias element for providing proper antecedent basis;

wherein upon biasing said housing bias portion, said aperture expands in size.

3. The connector of claim 2, wherein said movable and stationary portions are disposed substantially within a first plane, and said variable geometry portion is disposed substantially within a second plane, said first and second planes being substantially parallel.

4. The connector of claim 2, wherein said movable and stationary portions are disposed substantially within a first plane, and said variable geometry portion is disposed substantially within a second plane, said first plane being disposed above said second plane relative to the direction of insertion of said terminal into said aperture.

5. The connector of claim 2, wherein said bias element is formed from a single piece of electrically conductive metal.

6. The connector of claim 2, wherein said terminal comprises a terminal selected from the group consisting of: (i) an ECG terminal and (ii) an ICG terminal.

7. An electrical connector, comprising:

a unitary spring element having:

first and second substantially opposing portions;

first and second connecting portions coupled to respective ones of said first and second opposing portions;

a variable geometry portion coupled to both said connecting portions and comprising a variable size aperture, said aperture being configured to receive a terminal when properly expanded; and a housing element having first and second movable bias portions, said movable bias portions communicating with respective ones of said opposing portions;

wherein upon biasing at least one of said first and second bias portions, said aperture expands in size.

8. A low-force electrical connector, comprising:

a bias element having:

first and second substantially opposing portions adapted to move relative to one another;

first and second connecting portions coupled to respective ones of said first and second opposing portions;

an aperture portion coupled to both said connecting portions and comprising a variable size aperture, said aperture being configured to receive a terminal; and a housing element substantially containing said bias element, said housing having an opening formed therein substantially coincident with said aperture;

wherein upon biasing said connector onto said terminal, said aperture at least temporarily expands in size to receive said terminal in a frictional engagement.

9. The connector of claim 8, wherein said terminal comprises a substantially rounded head region, and said aperture portion is configured to cooperate with said head region to cause said expansion of said aperture during said act of biasing.

10. The connector of claim 9, wherein said configuration of said aperture portion comprises providing said aperture portion of said bias element with a substantially rounded profile, said rounded profile cooperating with said substantially rounded head to minimize friction during said expansion.

11. The connector of claim 8, wherein said bias element is adapted such that said act of biasing said connector onto said terminal causes said first and second substantially opposing portions to become closer to one another.

12. The connector of claim 8, wherein said act of biasing said connector onto said terminal is accomplished without any inward external bias force being applied to either of said substantially opposing portions.

13. The connector of claim 1, wherein said movable actuation elements are disposed substantially within a first plane, and said variable geometry portion is disposed substantially within a second plane, said first and second planes being substantially parallel.

14. The connector of claim 1, wherein said movable actuation elements are disposed substantially within a first plane, and said variable geometry portion is disposed substantially within a second plane, said first plane being disposed above said second plane relative to the direction of insertion of said terminal into said aperture.

15. The connector of claim 1, wherein said terminal comprises a terminal selected from the group consisting of: (i) an ECG terminal and (ii) an ICG terminal.

16. The connector of claim 1, wherein said terminal comprises a substantially rounded head region, and said aperture portion is configured to cooperate with said head region to assist said expansion of said aperture during said act of biasing, and when a normal force is contemporaneously applied to said connector.

17. The connector of claim 16, wherein said unitary substantially metallic spring element comprises a substantially rounded cross-sectional profile, said substantially rounded profile cooperating with said substantially rounded head to minimize friction during said biasing and application of said normal force.

18. The connector of claim 1, wherein said unitary substantially metallic spring element is adapted such that said act of biasing causes said first and second substantially opposing bias portions to become closer to one another.

19. A low-force electrical connector for use in impedance cardiography systems, comprising:

a one-piece bias metallic element having:

first and second substantially opposing portions adapted to move relative to one another;

first and second connecting portions coupled to respective ones of said first and second opposing portions;

an aperture portion coupled to both said connecting portions and comprising a variable size aperture, said aperture being configured to receive a terminal of an impedance cardiography electrode patch; and a substantially non-conductive housing element substantially containing said bias element, said housing having an opening formed therein substantially coincident with said aperture;

wherein upon biasing said connector onto said terminal, said aperture at least temporarily expands in size to receive said terminal in a frictional engagement and wherein said aperture portion and said first and second substantially opposing portions are disposed at different vertical heights from one another within said connector.

* * * * *

UNITED STATES PATENT AND TRADEMARK OFFICE

CERTIFICATE OF CORRECTION

PATENT NO. : 7,214,107 B2
APPLICATION NO. : 10/995610
DATED : May 8, 2007
INVENTOR(S) : Francis Powell et al.

It is certified that error appears in the above-identified patent and that said Letters Patent is hereby corrected as shown below:

Cover Page:

"(75) Inventors: Francis Powell, Cheshire, CT (US);
John Janczek, Lino Lakes, MN (US);
Dennis G. Hepp, Coon Rapids, MN (US)"

Should Read:

-- (75) Inventors: Francis Powell, Cheshire, CT (US);
John Jancsek, Lino Lakes, MN (US);
Dennis G. Hepp, Coon Rapids, MN (US) --

Signed and Sealed this

Twenty-ninth Day of July, 2008

JON W. DUDAS
*Director of the United States Patent and Trademark Office*